US007374470B2

(12) United States Patent
Fuchs

(10) Patent No.: US 7,374,470 B2
(45) Date of Patent: May 20, 2008

(54) KNIFE SHARPENING APPARATUS

(76) Inventor: Richard W. Fuchs, 17 Deerfield La., Simsbury, CT (US) 06070

( * ) Notice: Subject to any disclaimer, the term of this patent is extended or adjusted under 35 U.S.C. 154(b) by 0 days.

(21) Appl. No.: 11/787,035

(22) Filed: Apr. 13, 2007

(65) Prior Publication Data

US 2007/0243799 A1 Oct. 18, 2007

Related U.S. Application Data

(60) Provisional application No. 60/791,977, filed on Apr. 13, 2006.

(51) Int. Cl.

| | |
|---|---|
| ***B24B 3/54*** | (2006.01) |
| ***B24B 21/00*** | (2006.01) |
| ***B24B 49/00*** | (2006.01) |
| ***B24B 51/00*** | (2006.01) |

(52) U.S. Cl. ..... 451/5; 451/45; 451/297; 451/310; 451/311; 451/451

(58) Field of Classification Search ..... 76/82.2, 76/83, 84; 198/807, 810.03; 451/8, 9, 10, 451/45, 297, 310, 311, 451

See application file for complete search history.

(56) References Cited

U.S. PATENT DOCUMENTS

| | | | | |
|---|---|---|---|---|
| 2,232,149 | A | 2/1941 | Tautz | |
| 2,423,737 | A | 7/1947 | Tavano | |
| 2,463,287 | A | 3/1949 | Krueger | |
| 2,640,303 | A | 6/1953 | Johnson | |
| 2,780,897 | A | 2/1957 | Radase | |
| 2,791,986 | A | 5/1957 | Taylor | |
| 3,971,166 | A | 7/1976 | Habeck et al. | |
| 4,043,082 | A | 8/1977 | Ferroglio | |
| 4,294,044 | A | 10/1981 | Hansen | |
| 4,320,892 | A | 3/1982 | Longbrake | |
| 4,509,296 | A | 4/1985 | Rasmussen | |
| 4,742,649 | A | 5/1988 | Fuchs | |
| D305,029 | S | 12/1989 | Fuchs | |
| 5,036,626 | A | 8/1991 | Fuchs | |
| 5,168,658 | A | 12/1992 | Price | |
| 5,184,424 | A * | 2/1993 | Miller | 451/297 |
| 5,185,962 | A | 2/1993 | Liou | |
| 5,210,981 | A | 5/1993 | Urda | |

(Continued)

OTHER PUBLICATIONS

International Search Report and Written Opinion dated Sep. 25, 2007.

*Primary Examiner*—Timothy V Eley
(74) *Attorney, Agent, or Firm*—Michaud-Duffy Group, LLP

(57) ABSTRACT

A sharpening apparatus having at least one guide slot, a drive pulley drivingly coupled to a frame and at least one idler pulley rotatably coupled to a support member. The support member is pivotably coupled to the frame. The apparatus includes an endless abrading belt rotatable in a path over the drive pulley and the at least one idler pulley and a biasing member coupled to the frame for biasing the support member toward an engaged position. Pivotal movement of the support member adjusts tension in the belt. A tool is traversed into the guide slot for sharpening a cutting edge thereof. The belt and support member respond to application and release of a force applied to the belt by the cutting edge to decrease and increase, respectively, belt speed to preclude overheating of the cutting edge and damage to the belt and cutting edge.

20 Claims, 14 Drawing Sheets

U.S. PATENT DOCUMENTS 6,071,183 A 6/2000 Havins
6,137,974 A 10/2000 Williams et al.
6,544,112 B1 4/2003 Fuchs
6,594,460 B1 7/2003 Williams et al.
2001/0007813 A1* 7/2001 Cadrobbi ..... 451/526

* cited by examiner

KNIFE SHARPENING APPARATUS

This application claims priority from provisional application Ser. No. 60/791,977, filed Apr. 13, 2006, the disclosure of which is incorporated by reference herein, in its entirety.

FIELD OF THE INVENTION

The present invention is generally directed to a sharpening apparatus for cutting tools and is more specifically directed to a knife sharpening apparatus having an abrading belt that is capable of sharpening a cutting edge of knives and other cutting tools without overheating or damaging the cutting edge.

BACKGROUND OF THE INVENTION

Knife sharpening apparatuses of the type having an abrasive belt and means for supporting and driving the belt along an endless path are well known. It is also well known to use such machines for sharpening knives and other tools having elongated cutting edges. For a knife or the like to be optimally sharpened with such machines the cutting edge must engage the abrasive belt at an appropriate angle and with an appropriate amount of force applied to keep the cutting edge in contact with the belt. During the sharpening procedure heat is generated at and near an area of engagement between the cutting edge of the knife and the abrasive belt. If the applied force is too great, the cutting edge overheats resulting in a change in the microstructure of the cutting edge and a reduction of the surface hardness of the cutting edge. In addition, excessive force applied to the belt by the cutting edge can cause accelerated belt wear. On the other hand, if the applied force is inadequate to keep the cutting edge in contact with the belt, the sharpening procedure may require an undue amount of time. The cutting edge is an intersection of opposing faces of the knife disposed at a predetermined angle from one another. To optimize performance of the cutting edge, the angle between the opposing faces of the knife must be held within close tolerances at the cutting edge. Therefore, angular positioning of the knife relative to the belt affects sharpening quality.

To aid in the proper positioning of and the application of proper force to a knife being sharpened it is known to use a rest having a guide surface inclined with respect to the path of travel of the belt. It is also known that the guide surface includes an index mark established, usually by trial and error, on the surface indicating the point to which a knife is to be moved for proper sharpening. However, this does not preclude the possibility of the knife being accidentally or intentionally moved beyond the index mark, creating overheating of the cutting edge, belt damage and other problems.

U.S. Pat. No. 5,036,626 proposes the use of plastic unloader discs positioned on opposing sides of the belt of an abrading type knife sharpening machine to carry the knife edge away from the belt when excessive force is applied by the user to the knife and belt. However, the unloader discs can wear and therefore become less effective.

Some knife sharpeners of the belt abrading type have belts which travel at a relatively constant speed regardless of the force applied by the knife to the belt during a sharpening operation. In such knife sharpeners, overheating of and damage to the cutting edge can occur quickly when excessive force is applied, because the belt does not slow or stop relative to the force applied.

Belt abrading knife sharpeners have been provided in enclosed housings to protect the user's clothing, fingers or other objects from being entangled with the moving parts of the knife sharpener. However, some housings are comprised of two housing portions rotatably connected by a hinge so that opposing housing portions can be rotated relative to each other to access internal parts of the knife sharpener, for example, for changing the belt. If the two housing portions are rotated apart from one another while the belt is operating, rotating parts thereof are exposed and a safety hazard can result.

Many knife sharpeners are large, heavy and suitable primarily for commercial uses, for example, in a butcher's shop, grocery store or the like. Such knife sharpeners have not been frequently used by individual home owners because the size and weight of the knife sharpener makes it impractical for home countertop use. Moreover, such units generally operate on 120 volt A/C power which requires the knife sharpener to be stationed within access to a suitable power supply and requires use of relatively expensive motors.

Belt grinders or sanders of the general type having a belt drive pulley, at least one driven or idler pulley and an endless abrasive or other belt trained over the pulleys are known in the art, as evidenced by U.S. Pat. Nos. 3,497,336 and 4,294,044. During the operation of such a machine, it is desirable that the belt track is aligned properly over the pulleys. That is, it is desirable that the belt maintain a position substantially laterally centered on the belt engaging faces of the pulleys. However, slight alignment errors in the relation of the axes of the pulleys to one another or slight variations in the lengths of the edges of the belt can cause the belt to move off track by shifting laterally to one side or the other from the desired centered position. In some instances, the belt may run completely off of the pulleys or rub against a wall or other structure of the machine located adjacent one or both of the pulleys or the belt, resulting in the shortening of belt and/or machine life.

To allow for correction of the running path of the belt, it has been common practice in belt abrading machines to provide a means for adjusting the inclination of an idler pulley axis relative to a drive pulley axis. Such adjustment means have however tended to pose various problems of their own, including being of a complex, expensive construction and being difficult to operate or fine tune during operation.

Thus there is a need to provide a knife sharpening machine that accurately sharpens a knife without overheating or damaging the cutting edge, that is light weight, compact, inexpensive, does not require belt alignment and does not pose a safety risk. Prior art methods and systems for addressing these needs are either too expensive, too complicated, ineffective or a combination of all of these. Based on the foregoing, it is the general object of the present invention to improve upon prior art knife sharpening machines and methods and overcome the problems and drawbacks thereof.

SUMMARY OF THE INVENTION

One aspect of the present invention includes an apparatus for sharpening a cutting tool having a cutting edge, including a frame having at least one guide slot and a motor having a drive shaft. The motor is coupled to the frame and the drive shaft defines a drive pulley rotational axis. The apparatus includes a drive pulley coupled to the drive shaft and rotating about the drive pulley rotational axis when the motor is activated. The apparatus includes at least one idler pulley rotating about an idler pulley rotational axis and a support member pivotably coupled to the frame and pivoting about a support member rotational axis between an engaged position and a disengaged position. The idler pulley rotational axis is fixed relative to the support member. The apparatus also includes an endless belt having an abrading surface. The endless belt is trained in a path over the drive pulley and the at least one idler pulley. The endless belt rotates along the path in response to rotation of the drive pulley. The apparatus includes a biasing member coupled to the frame and biasing the support member toward the engaged position. When the cutting edge traverses the at least one guide slot in a direction toward the endless belt, the cutting edge engages the abrading surface imparting a force on the belt to sharpen the cutting edge. When the force is at and below a first threshold, the support member is in the engaged position and the belt rotates along the path at a first rotational speed. When the force increases from the first threshold toward a second threshold, the support member and biasing member respond to the force to pivot the support member from the engaged position toward the disengaged position and decrease tension in the belt such that the belt rotates along the path at a second rotational speed that is reduced from the first rotational speed.

In another aspect of the present invention, when the force increases to the second threshold, the support member and biasing member respond to the force to pivot the support member into the disengaged position and release substantially all tension in the belt causing the belt to stop travel along the path.

In addition, when the cutting edge traverses the guide slot in a direction away from the endless belt, the force decreases and the support member and biasing member respond to the decreasing force to pivot the support member toward the engaged position and increase tension in the belt such that the belt rotates along the path toward the first rotational speed.

One aspect of the present invention includes a method for sharpening a cutting edge of a cutting tool, the method includes the step of providing an endless belt rotating in a path about a plurality of pulleys. At least one of the pulleys is affixed to a support member pivoting about a rotational axis between an engaged position and a disengaged position. The method also includes engaging the belt with the cutting edge to impart a force on the belt and sharpen the cutting edge. When the force is at and below a first threshold, the support member is in the engaged position and the endless belt rotates at a first rotational speed. The force is then increased above the first threshold toward a second threshold. In response to the increased force, the support member rotates from the engaged position toward the disengaged position, decreasing a tension in the belt such that the belt rotates at a second rotational speed that is less than the first rotational speed.

DETAILED DESCRIPTION OF THE PREFERRED EMBODIMENT

Figure 1:
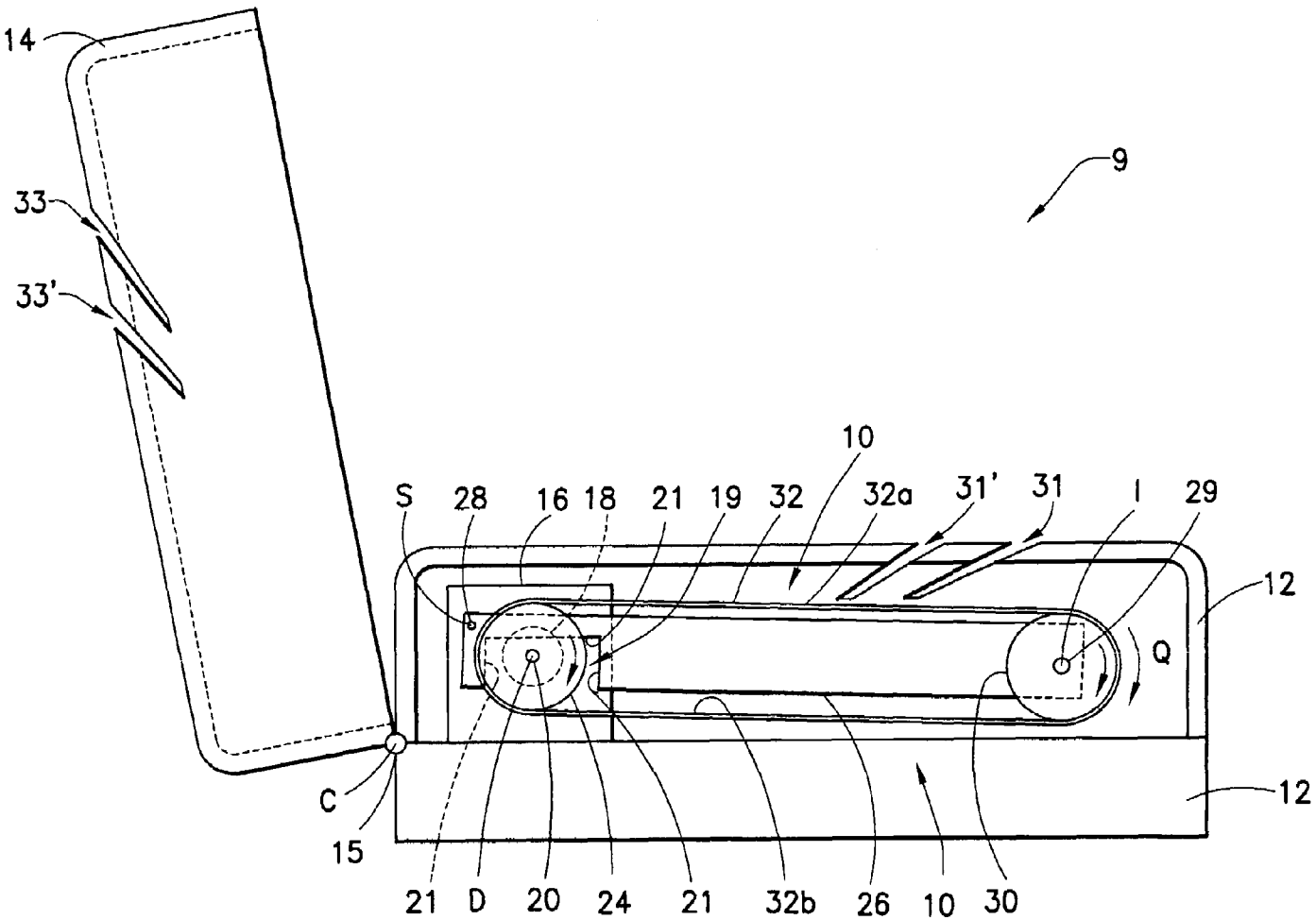
FIG. 1 is front view of a sharpening apparatus with a portion of a cover open, in accordance with the teachings of the present invention.
Figure 2:
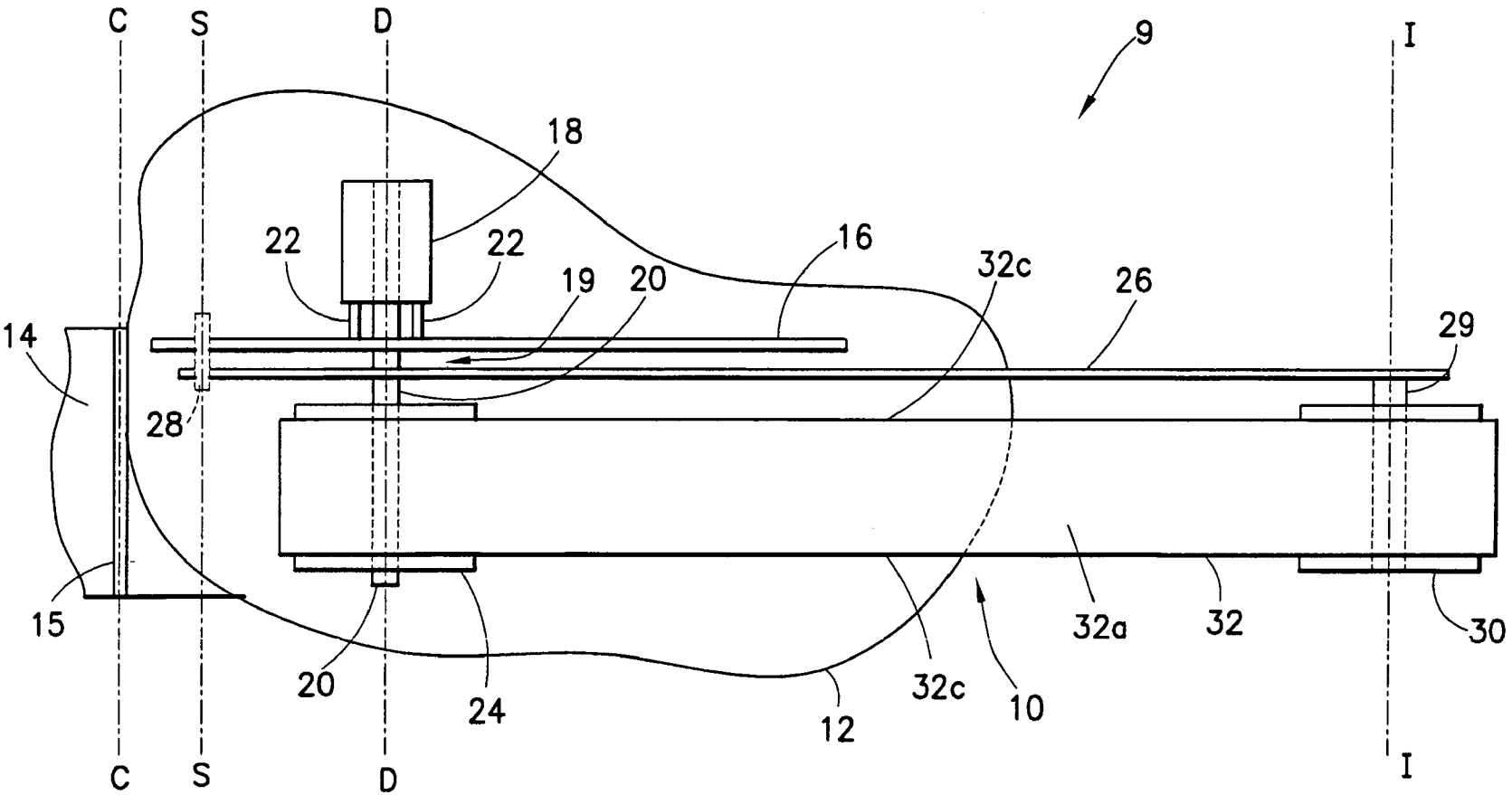
FIG. 2 is a top view of a portion of the apparatus of FIG. 1 with the cover removed and showing a portion of the frame.
Figure 5:
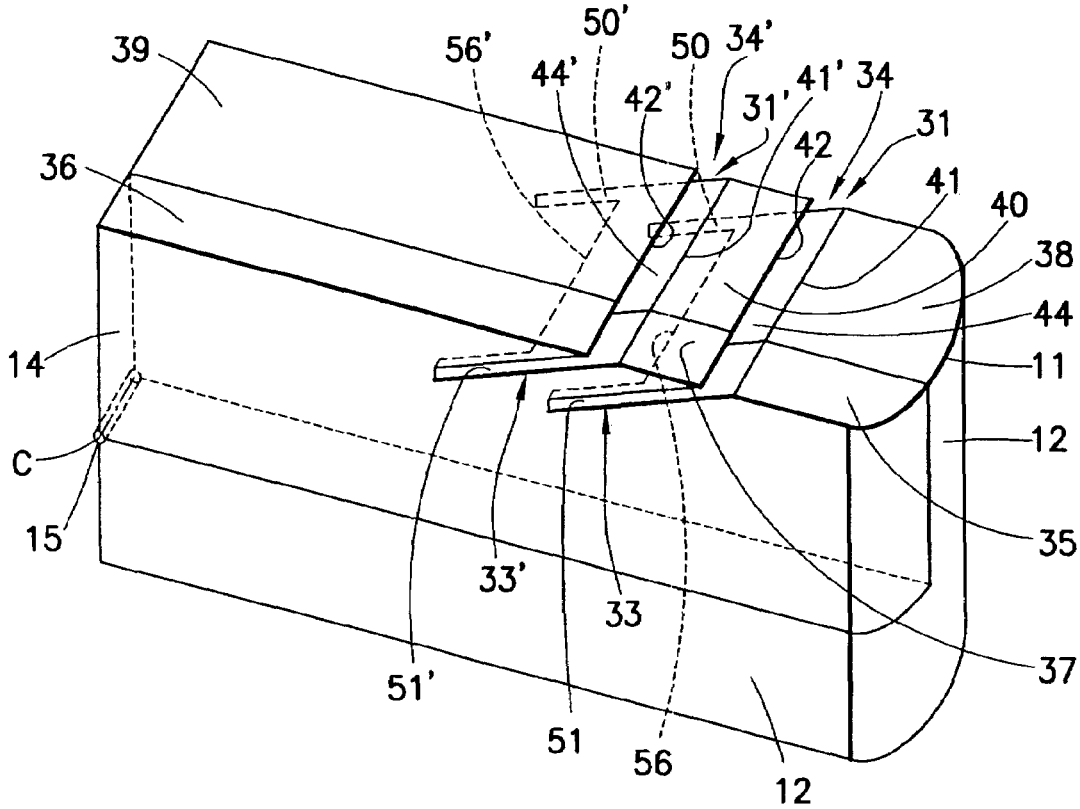
FIG. 5 is a perspective view of the sharpening apparatus of FIG. 1 illustrating a frame and a cover, with the cover closed.

FIGS. 1 and 2 illustrate a sharpening apparatus, indicated generally at 9, for sharpening knives and other cutting tools having at least one elongated edge. The knife sharpening apparatus 9 includes a frame 12 and a cover 14 hingedly coupled to the frame by a hinge device 15, for rotational movement about a cover rotational axis C between an open and a closed position. In one embodiment, the hinged device 15 is releasable, enabling the cover 14 to be removed from the frame 12. In FIG. 1 the cover 14 is shown in an open position. The frame 12 and cover 14 collectively house a pulley and belt assembly 10 including a drive pulley 24, an idler pulley 30 and an endless belt 32 mounted for rotation between the pulleys. The frame 12 includes two frame guide slots segments 31, 31' and the cover 14 includes two cover guide slot segments 33, 33'. When the cover 14 is closed against the frame 12, the frame guide slot segments 31, 31' and the cover guide slot segments 33, 33' cooperate to define two operational guide slots 34, 34' (FIG. 5). During operation, a knife blade is positioned so that the cutting edge thereof is guided into grinding engagement with an abrasive surface 32*a* of the endless belt 32. The operational guide slots 34, 34', as described in greater detail below, are sized to allow limited angular rotation of a cutting edge relative to the endless belt 32.

Figure 3:
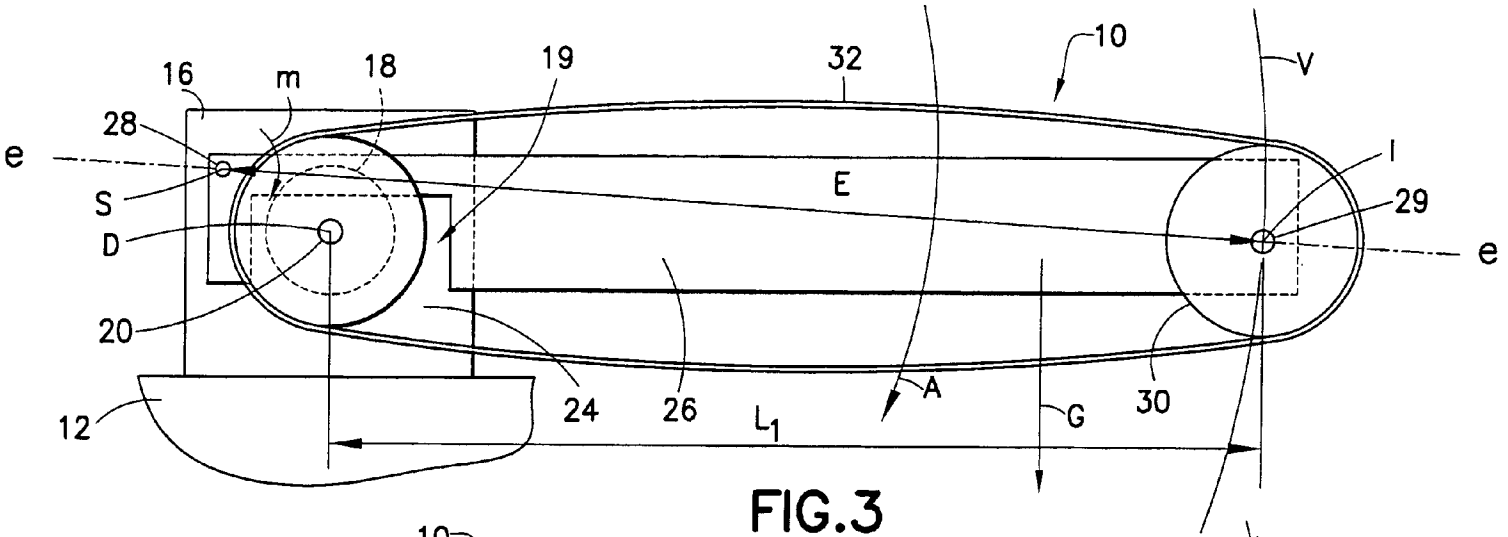
FIG. 3 is a side view of the pulley and belt assembly in a disengaged position.

Referring to FIGS. 1-3, the frame 12 includes a mounting plate 16 projecting therefrom. An electric motor 18, having a drive shaft 20, is coupled to the mounting plate 16 by at least one first fastener 22. In one embodiment, the motor 18 is powered by a battery (not shown). A drive pulley 24 is mounted to the drive shaft 20 for rotation about a drive pulley rotational axis D fixed relative to the frame. The knife sharpening apparatus 9 includes a support member 26 rotatably mounted to the mounting plate 16 by a second fastener 28 about a support member rotational axis S fixed relative to the frame 12. The support 26 includes a stud 29 projecting therefrom and coaxial with an idler pulley rotational axis I fixed relative to the support member. In one embodiment, the support member 26 includes a partial perimeter 21 which defines a clearance area 19 for the motor shaft to transverse through. The cover rotational axis C, the drive pulley rotational axis D, the support member rotational axis S and the idler pulley rotational axis I are horizontally spaced apart from and are substantially parallel to one another, as illustrated in FIG. 2. The idler pulley 30 is rotatably mounted to the stud 29 for rotation about the idler pulley rotational axis I. In one embodiment the drive pulley rotational axis D is positioned between the support pulley rotational axis S and the idler pulley rotational axis I. The support member 26 extends from the support member rotational axis S and over the drive shaft 20. Therefore, when the drive pulley rotational axis D is positioned between the support pulley rotational axis S and the idler pulley rotational axis I, a distance E between the support member rotational axis S and the idler pulley rotational axis I is greater than when the support member rotational axis S is positioned between the drive pulley rotational axis D and the idler pulley rotational axis I as may be seen in the prior art. The distance E is inversely proportional to a force, acting perpendicular to an axis e-e intersecting the support member rotational axis S and the idler pulley rotational axis I, required to rotate the support member 26. With less force required to rotate the support member 26, the support member 26 is rotatable by application of a force applied by the knife blade. While the support member 26 is described as having one stud 29 projecting therefrom and one idler pulley 30 rotatably mounted to the stud, the present invention is not limited in this regard as the support member is adapted to include any number of studs projecting therefrom, any number of idler pulleys rotatably mounted to the respective studs and positioned in other orientations. While the mounting plate 16 is shown positioned adjacent to the motor 18 with the support plate positioned on an opposing side of the mounting plate, the present invention is not limited in this regard as the relative positions of the mounting plate 16 and the support member 26 can be reversed.

Still referring to FIGS. 1 and 2, the endless belt 32 includes an outwardly facing abrasive surface 32*a*, inwardly facing drive surface 32*b* and two side edges 32*c*. The belt 32 is mounted on and travels in an endless path around the drive pulley 24 and the idler pulley 30. As viewed in FIG. 1, the drive pulley 24, the idler pulley 30 and the endless belt 32 travel in a clockwise direction as indicated by an arrow Q. "Endless" as used in "endless belt" herein, means that opposing ends of a belt length are joined to one another, for example, by a joint including a suitable adhesive means. In one embodiment, the joint is a bidirectional joint such that the belt is suitable for either clockwise or counterclockwise rotation.

Figure 4:
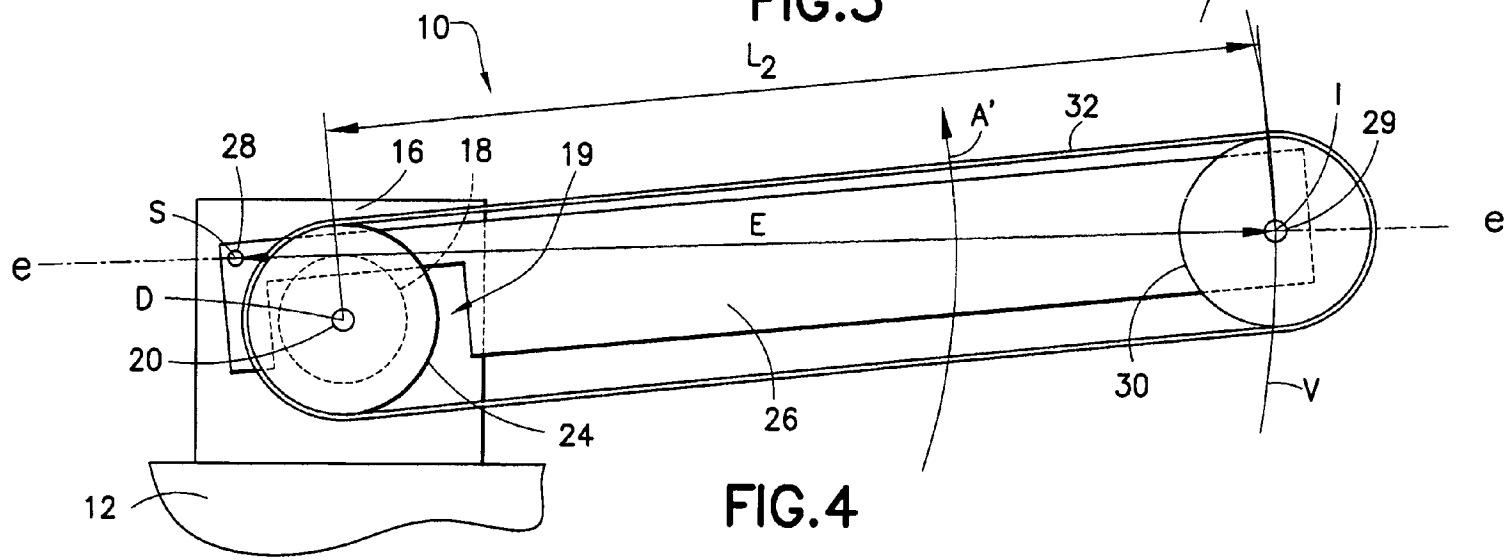
FIG. 4 is a side view of the pulley and belt assembly in an engaged position.

Referring to FIG. 3, rotation of the support member 26 about the support member rotational axis S defines an arc V having a radius E equal to a spacing between the support member rotational axis S and the idler pulley rotational axis I which is fixed relative to the support member 26. Therefore, rotation of the support member 26 about the support member rotational axis changes a distance between the idler pulley rotational axis I and the drive pulley rotational axis D. Change in the distance between the idler pulley rotational axis I and the drive pulley axis D affects the tension in the belt. For example, in FIG. 3 the belt and pulley assembly 10 is shown with the support member 26 rotated clockwise, about the support member rotational axis S, in the direction indicated by arrow A into a disengaged position, wherein a distance between the drive pulley rotational axis D and the idler pulley rotational axis I is a length L1 and tension in the belt 32 is relieved. In the disengaged position, the belt 32 can be removed and/or installed on the drive pulley 24 and the idler pulley 30. In addition, when in the disengaged position, the belt 32 is in a relaxed state thus reducing the tendency of belt set caused by maintaining tension on the belt when the belt is not moving. In FIG. 4, the belt and pulley assembly 10 is shown with the support member 26 rotated counterclockwise, about the support member rotational axis S, in the direction indicated by arrow A' into an engaged position, wherein a distance between the drive pulley rotational axis D and the idler pulley rotational axis I is a length L2. The length L2 is greater than the length L1 such that the belt 32 is tensioned when the support member 26 is in the engaged position. In one embodiment, the support member 26 is biased to the disengaged position by gravity forces G acting on the support member causing a moment M about the support member rotational axis S. While the support member 26 is described as being biased toward the disengaged position by the force of gravity, the present invention is not limited in this regard as the support member is adaptable to be biased to the disengaged position by a biasing member and/or be encouraged to the disengaged position by application of another force applied to the support member.

Figure 6:
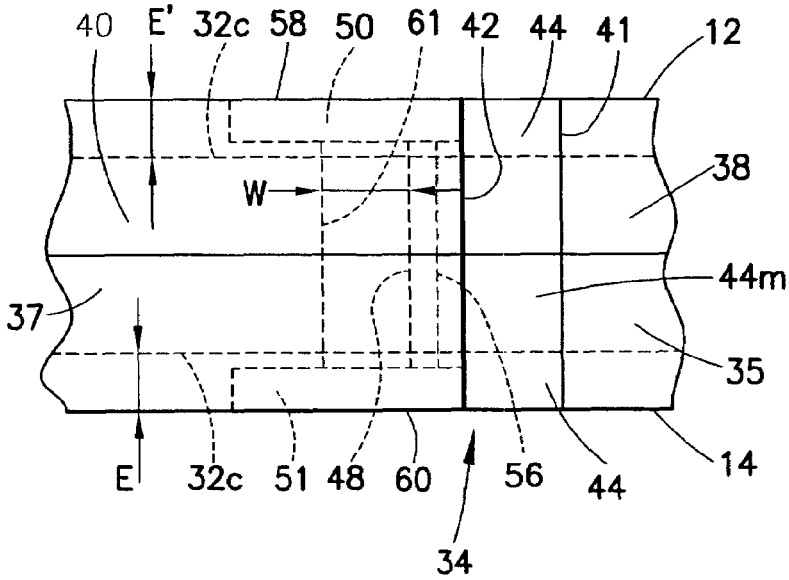
FIG. 6 is a partial top view of the frame and cover of FIG. 5.
Figure 7:
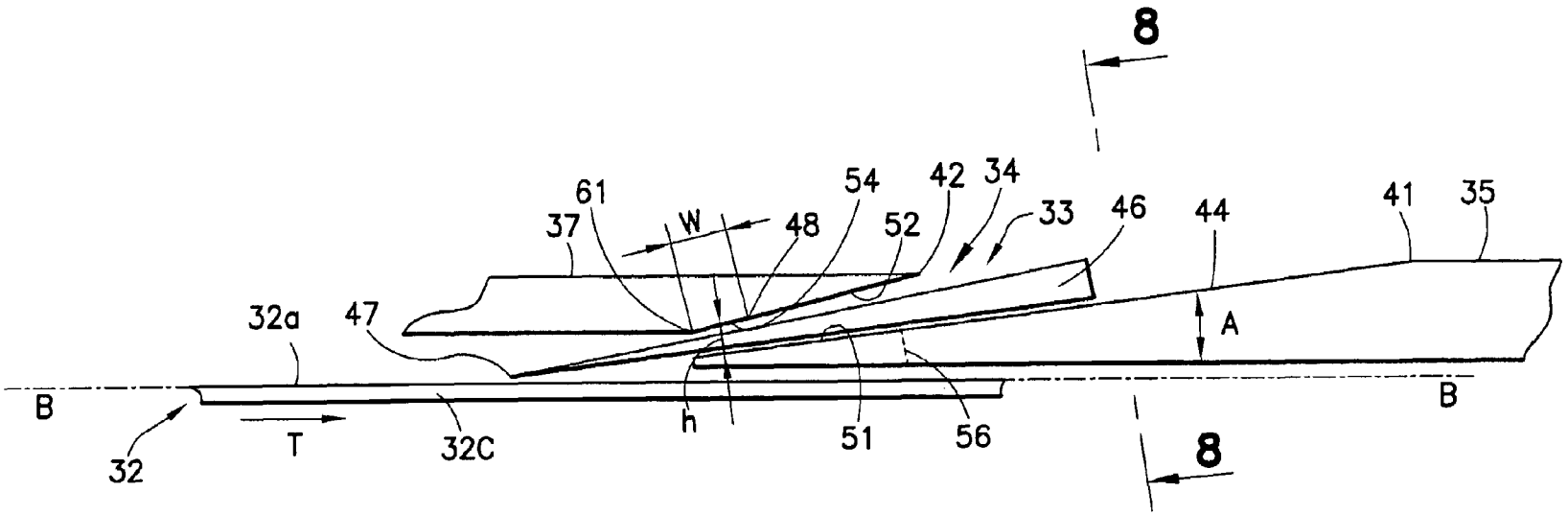
FIG. 7 is a partial cross sectional view of the cover, with a knife blade shown in a guide slot.

Referring to FIGS. 5-7, the frame 12 and cover 14 are shown with the cover closed and the frame guide slot segments 31 and 31' and the cover guide slot segments 33 and 33' aligned with one another, respectively, and cooperating to form the two operational guide slots 34 and 34'. The cover 14 includes a first cover surface 35 on a top cover surface of one end of the cover, a second cover surface 36 on the top cover surface of an opposing end of the cover and an intermediate cover surface 37 disposed on the top cover surface, between the two cover guide slot segments 33, 33'. The frame 12 includes a first frame surface 38 on a top frame surface of one end of the frame, a second frame surface 39 on the top frame surface of an opposing end of the frame and an intermediate frame surface 40 disposed on the top frame surface, between the two frame guide slot segments 31, 31'. In one embodiment, the cover 14 and frame 12 include an alignment device to maintain alignment therebetween and to ensure proper formation of the operational guide slots 34 and 34'. In one embodiment the alignment device includes a pin and bore mechanism. In another embodiment, the cover 14 and frame 12 include an interlock device that prevents operation of the motor when the cover is open. While the frame 12 and cover 14 are described as cooperating to form two guide slots 34 and 34', the present invention is not limited in this regard as other arrangements for accommodating the guide slots are also suitable including but not limited to a one piece cover with at least one guide slot formed therein and various guide slot supporting fixtures secured to the frame.

Referring again to FIGS. 5-7, the guide slot 34 is shown with the knife blade 46 having an elongated cutting edge 47 positioned therein for sharpening. The guide slot 34 includes a lower guide surface 44 and upper guide surfaces to allow limited angular rotation of the knife blade 46, relative to the endless belt 32. The first cover surface 35 and the first frame surface 38 slope downwardly from a first line of inclination 41 to form the lower guide surface 44, a mid-section 44M of which terminates along line 56. The lower guide surface is disposed at an angle A relative to the abrasive surface 32*a* defined by plane B. In one embodiment the angle A is approximately 15 degrees. In another embodiment, angle A is approximately 20 degrees. The frame 12 and cover 14 include a frame side wall 58 and a cover side wall 60. Portions of the frame side wall 58 and the cover side wall 60 define a frame side wall guide surface 50 and a cover side wall guide surface 51, respectively. The frame side wall guide surface 50 and the cover side wall guide surface 51 extend from and are coplanar with the guide surface 44. In one embodiment, at least one of the guide slots includes a biasing member to bias the knife blade 46 against the guide surface 44. While the angle A is described as being approximately 15 or 20 degrees, the present invention is not limited in this regard, as in one embodiment the sharpening apparatus is adaptable to any angle suitable to sharpening knife and tool edges.

Figure 8:
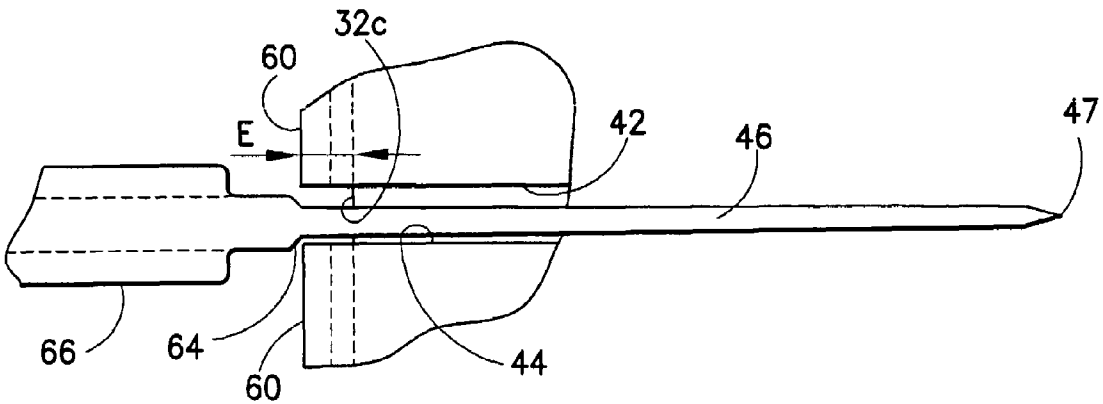
FIG. 8 is a top view of a portion of a guide slot taken along line 8-8 of FIG. 7.

Referring to FIG. 8, the knife blade 46 is shown having a bolster 64 between the blade and a handle portion 66. The bolster 64 is shown abutting the outside surface 60. The outside surface 60 of the cover 14 is positioned adjacent to one of the side edges 32*c* of the belt to minimize the span E therebetween and to enable the knife blade 46 to engage the belt 32 close to the bolster. Referring now to FIG. 6, the outside surface 58 is positioned adjacent the other side edge 32*c* in a similar manner as that described above for the outside surface 60 to minimize the span E' between the outside surface 58 and the side edge 32*c*.

As shown in FIGS. 6-7, the guide slot 34 includes a first upper guide surface 52 extending downwardly from a common edge 42 of the intermediate cover surface 37 and the intermediate frame surface 40 to a second line of inclination 48 where the first upper guide surface 52 transitions into a second upper guide surface 54 and extends to a third line of inclination 61. The second upper guide surface 54 is substantially parallel to the lower guide surface 44. In one embodiment, the second upper guide surface 54 extends a length W between the second line of inclination 48 and the third line of inclination 61, wherein the length W is approximately ⅜ inch. In one embodiment, the lower guide surface 44 and the second upper guide surface 54 are spaced apart by a distance h, wherein the distance h is approximately 1/16 inch. While in one embodiment the distance h is said to be 1/16 inch the present invention is not limited in this regard as other values of h are also acceptable and depend on dimensions including thickness of the knife blade 46.

Referring again to FIGS. 5-7, similar to that described above for guide slot 34, guide slot 34' includes a lower guide surface 44' and upper guide surfaces. The intermediate cover surface 37 and the intermediate frame surface 40 slope downwardly from a first line of inclination 41' to form the guide surface 44, a mid-section of which terminates along line 48'. Portions of the frame side wall 58 and the cover side wall 60 define a frame side wall guide surface 50' and a cover side wall guide surface 51', respectively. The frame side wall guide surface 50' and a cover side wall guide surface 51' extend from and are coplanar with the guide surface 44'. Similar to that described above for guide slot 34, guide slot 34' includes a first upper guide surface extending downwardly from a common edge 42' of the second cover surface 36 and the second frame surface 39 to a second line of inclination where the upper guide surface transitions into a second upper guide surface and extends to a third line of inclination. The second upper guide surface is substantially parallel to the lower guide surface 44'.

As shown in FIG. 7, one side of the knife blade 46 engages the lower guide surface 44 and a portion of an opposing side of the knife blade engages or is in close proximity to the second upper guide surface 54 to position and guide the knife blade at a fixed angle relative to the belt abrasive surface 32*a*. While guide slots 34 and 34' are shown having guide surfaces with fixed angles relative to the belt abrasive surface 32*a*, the present invention is not limited in this regard, as it can be appreciated that the guide slot are adaptable to be adjustable or the knife sharpening apparatus is adapted to include a plurality of guide slots having any number of different guide surfaces with other angles relative to the belt abrasive surface 32*a*.

Figure 9:
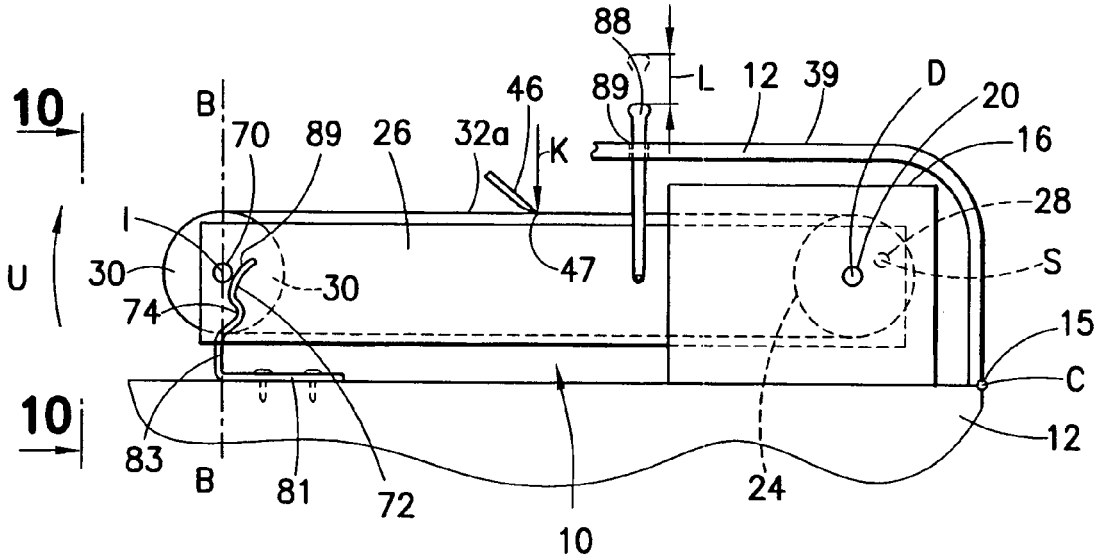
FIG. 9 is a back side view of a support member and a mounting plate, of FIG. 1.
Figure 10:
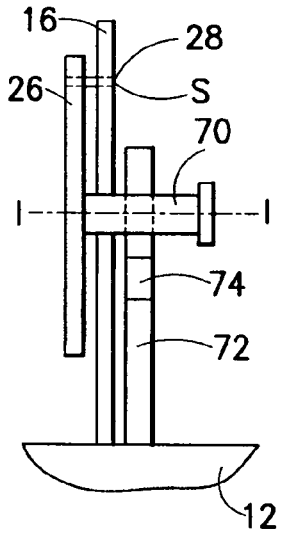
FIG. 10 is a front view taken along line 10-10 of FIG. 9.
Figure 11:
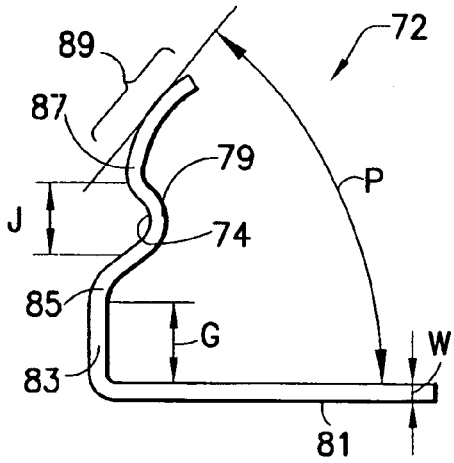
FIG. 11 is an enlarged detail view of a biasing member.

Referring to FIGS. 9-11, the pulley and belt assembly 10 is shown biased upwardly in the direction indicated by arrow U by a biasing member 72 having a first leg 81 and a second leg 83, as described in more detail below. The first leg 81 is secured to the frame 12 and a portion of the second leg 83 engages a portion of the support member 26. In one embodiment, the support member includes at least one journal 70 projecting therefrom and the biasing member slidingly engages the at least one journal 70. In one embodiment, the biasing member 72 includes a detent device 74. In one embodiment, the journal 70 is coaxial with the idler pulley rotational axis I. In one embodiment, the biasing member 72 is a length of spring steel wire and the detent device 74 is a bend formed in the wire.

Referring to FIG. 11, in one embodiment, the biasing member 72 is an L-shaped metal rod having a diameter of, for example, 1/16 inch. The second leg 83 includes a first bend 85 initiating inwardly towards the first leg 81 at a distance of approximately ¾ inches upwardly from the first leg 81 as illustrated by dimension G, a second bend 79 and a third bend 87. The second bend 79 defines a substantially concave detent member 74 having an opening of approximately 3/16 inches as illustrated by dimension J. The detent member 72 includes a bearing surface 89 spanning approximately 7/16 inches between the third bend 87 and a distal end of the second leg 83. The bearing surface 89 is disposed at an angle P of approximately 30 degrees, relative to the first leg. As illustrated in FIG. 9, when installed, the first leg 81 is secured to a portion of the frame 12 and the bearing surface 89 and detent member 74 engage the journal 70. It can be appreciated that the above dimensions are exemplary and that the biasing member 72 is also operable with other values for the dimensions G, J, 89 and P.

Figure 12:
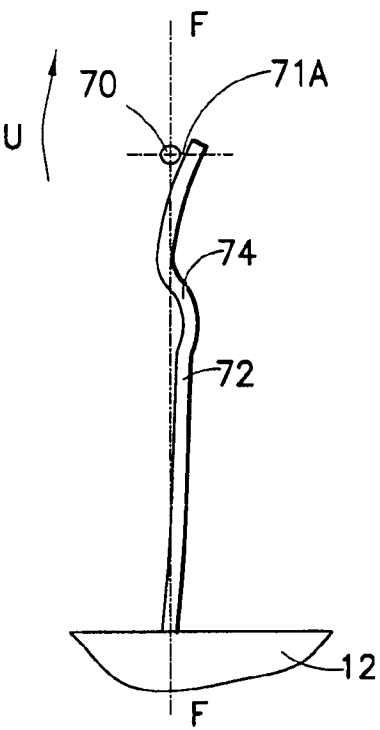
FIG. 12 is an enlarged detail view of a biasing member including a detent member and the journal of FIG. 9, in an engaged position.
Figure 16:
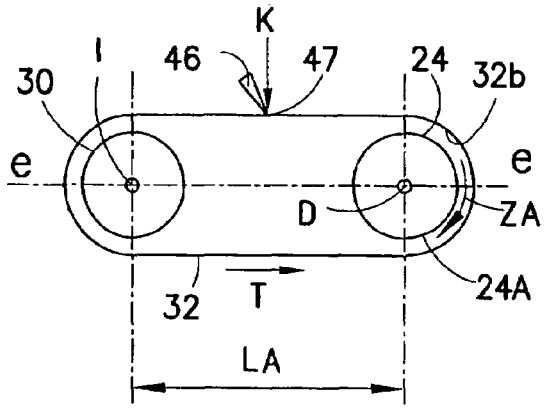
FIG. 16 is a partial view of the pulley and belt assembly corresponding to FIG. 12.

Referring to FIGS. 9, 12 and 16, the pulley and belt assembly 10 is shown in the engaged position with the belt 32 traveling in a direction indicated by arrow T at a normal operating speed on the pulleys. In one embodiment, the belt travels at a normal operating speed of approximately 2200 to 2400 feet per minute. In operation, a force is applied to the knife blade 46 such that the cutting edge 47 contacts the belt 32. The force has a component K which is perpendicular to the axis e-e intersecting the idler pulley rotational axis I and the support member rotational axis S. When the force K applied to the belt 32 by the cutting edge 47 is less than a first magnitude, the biasing member 72 engages the journal 70 at a first position 71A and the journal 70 and the biasing member are substantially aligned along axis F. In the first position 71A, the journal 70 and the pulley and belt assembly 10 are urged upwardly in the direction indicated by arrow U and the belt 32 is tensioned by the drive pulley rotational axis D and the idler pulley rotational axis I being urged apart by the biasing member 72, to a distance LA. In the first position 71A, tension in the belt 32 results in a first friction force ZA between the drive surface 32*b* and the circumferential surface 24A based on a static coefficient of friction between the drive surface and the circumferential surface. Therefore, in the first position 71A, there is no slippage between the drive surface 32*b* and the circumferential surface 24A. As such, the drive surface 32*b* of the belt 32 and the circumferential surface 24A of the drive pulley 24 allow the belt 32 to travel at about the normal operating speed.

Figure 13:
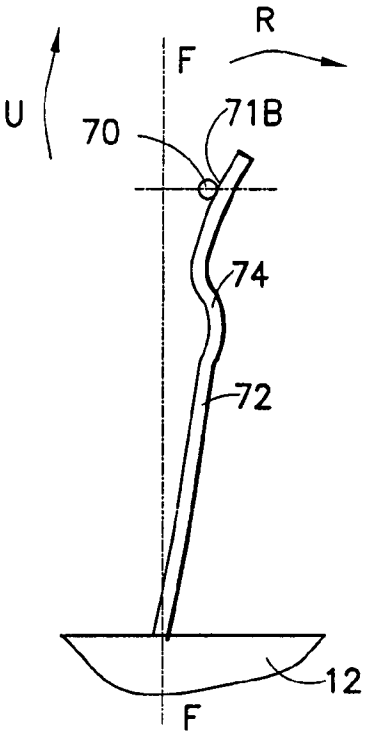
FIG. 13 is an enlarged detail view of the detent member and journal of FIG. 9 in a belt slip position.
Figure 17:
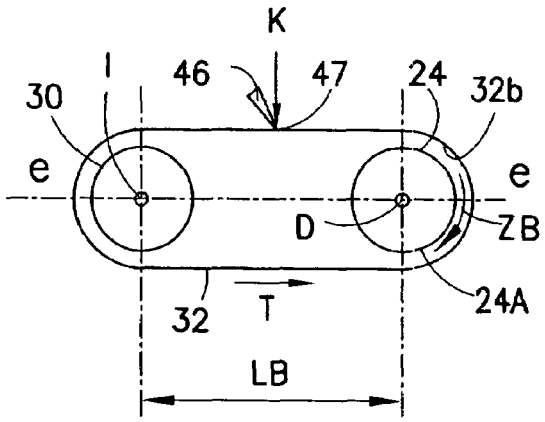
FIG. 17 is a partial view of the pulley and belt assembly corresponding to FIG. 13.

Referring to FIGS. 9, 13 and 17 the pulley and belt assembly 10 is shown in the engaged position with the belt 32 traveling in a direction indicated by the arrow T at less than the normal operating speed. When the force K applied to the belt 32 by the cutting edge 47 of the knife blade 46 is increased to a second magnitude greater than the first magnitude, the pulley and belt assembly 10 is urged downwardly opposite the direction indicated by the arrow U causing the journal 70 to move downwardly along the biasing member 72 and engages the biasing member at about a second position 71B. The biasing member 72 deflects to one side in the direction indicated by the arrow R. In the second position 71B, tension in the belt 32 is reduced by the drive pulley rotational axis D and the idler pulley rotational axis I being urged apart, to a lesser extent, by the biasing member 72, to a distance LB. The distance LB is less than the distance LA. In the second position 71B, tension in the belt 32 results in a second friction force ZB between the drive surface 32*b* and the circumferential surface 24A based on a first dynamic coefficient of friction, between the drive surface and the circumferential surface. The first dynamic coefficient of friction is less than the static coefficient of friction and the second friction force ZB is less than the first friction force ZA. Therefore, in the second position 71*b*, there is at least partial slippage between the drive surface 32*b* and the circumferential surface 24A. The partial slippage causes the belt 32 to travel within a first speed range having speeds less than the normal operating speed thus reducing the potential for overheating the cutting edge 47 of the knife blade 46 and preventing damage to the cutting edge and the belt. Thus, the force K exerted on the belt 32 is inversely proportional to speed at which the belt travels along the pulleys. In one embodiment, the first speed range is of from about 2000 feet per minute to about 1199 feet per minute. In addition, load on the motor 18 decreases as a result of the reduction in tension in the belt 32 and the reduced friction force ZB. Therefore, the drive surface 32*b* travels, at a speed greater than the normal operating speed. When the force K applied to the belt 32 by the cutting edge 47 of the knife blade 46 decreases to less than the second magnitude toward the first magnitude, the biasing member 72 engages the journal 70 at about the first position 71A, the pulley and belt assembly 10 are urged upwardly in the direction indicated by arrow U, tension in the belt 32 is again increased causing the belt to return to travel at the normal operating speed on the pulleys.

Figure 14:
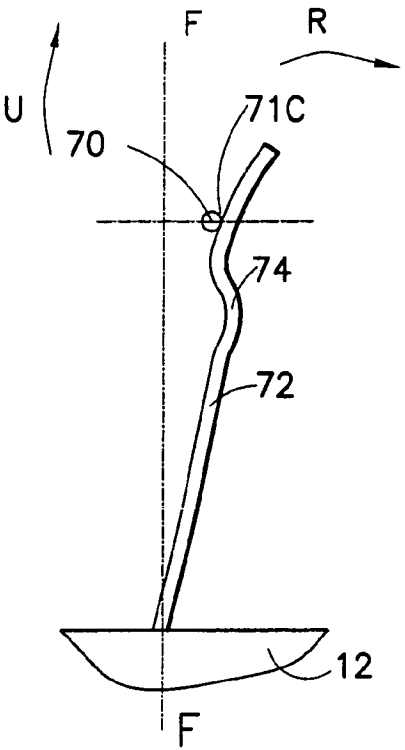
FIG. 14 is an enlarged detail view of the detent member and journal of FIG. 9 in a belt stopped position.
Figure 18:
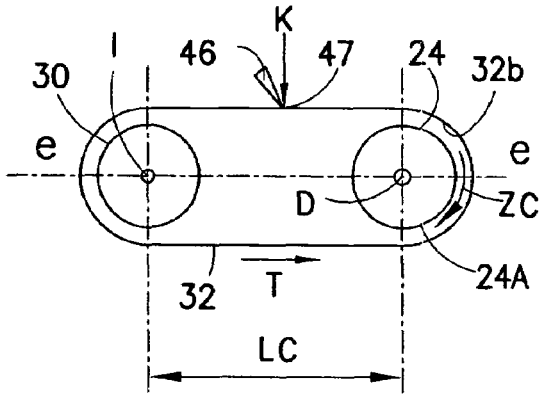
FIG. 18 is a partial view of the pulley and belt assembly corresponding to FIG. 14.

Referring to FIGS. 9, 14 and 18, the pulley and belt assembly 10 is shown in the engaged position with the belt 32 traveling in a direction indicated by arrow T within a second speed range on the pulleys. The second speed range includes speeds less than the speeds in the first speed range. In one embodiment, the second speed range includes a speed of zero. When the force K applied to the belt 32 by the knife blade 46 is further increased to a third magnitude greater than the second magnitude, the pulley and belt assembly 10 is urged further downwardly opposite the direction indicated by the arrow U causing the journal 70 to move further downwardly along the biasing member 72 and engage the biasing member 74 at about a third position 71C. The biasing member 72 deflects further to one side in the direction indicated by the arrow R. In the third position 71C, tension in the belt 32 is reduced by the drive pulley rotational axis D and the idler pulley rotational axis I being urged together to a distance LC, by the biasing member 72. The distance LC is less than the distance LB. In the third position 71C, tension in the belt 32 results in a third friction force ZC, based on a second dynamic coefficient of friction, between the drive surface 32*b* and the circumferential surface 24A. The second dynamic coefficient of friction is less than the first dynamic coefficient of friction and the third friction force ZC is less than the second friction force ZB. Therefore, in the third position 71C, there is additional slippage between the drive surface 32*b* and the circumferential surface 24A. The additional slippage causes the belt 32 to travel within the second speed range, to reduce the potential for overheating the cutting edge 47 of the knife blade 46 and to prevent damage to the cutting edge and the belt. In one embodiment, the second speed range is of from about 1700 feet per minute to about 2000 feet per minute. In addition, load on the motor 18 decreases as a result of the reduction in tension in the belt 32 and the reduced friction force ZC. Therefore, the circumferential surface 24A travels at a speed greater than the normal operating speed. When the force K applied to the belt 32 by the cutting edge 47 of the knife blade 46 decreases to less than the third magnitude, the biasing member 72 again engages the journal 70 at about the second position 71B, the pulley and belt assembly 10 are urged upwardly in the direction indicated by arrow U, and tension in the belt 32 is increased causing the belt to travel within the first speed range.

Figure 15:
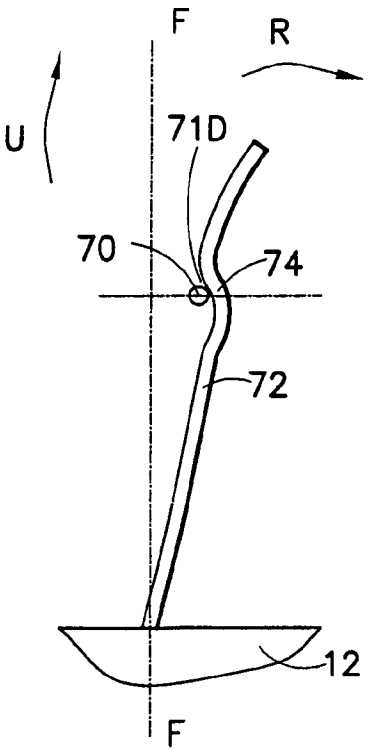
FIG. 15 is an enlarged detail view of the detent member and journal of FIG. 9 in a belt and motor stopped position.
Figure 19:
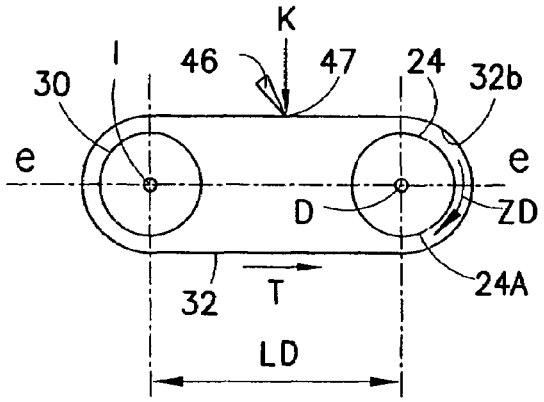
FIG. 19 is a partial view of the pulley and belt assembly corresponding to FIG. 15.

Referring to FIGS. 15 and 19, the pulley and belt assembly 10 is shown in the disengaged position. When the force K applied to the belt 32 by the knife blade 46 is further increased to a fourth magnitude greater than the third magnitude, the pulley and belt assembly 10 is urged further downwardly opposite the direction indicated by the arrow U causing the journal 70 to move further downwardly along the biasing member 72 and engage the biasing member 74 at about a fourth position 71D. The journal 70 engages the detent member 74 and the pulley and belt assembly 10 is releasably secured in the disengaged position. In the fourth position 71D, tension in the belt 32 is further reduced causing the belt 32 to slip on the drive pulley 24 and causing the belt to stop to prevent overheating the cutting edge 47 of the knife blade 46 and to prevent damage to the belt.

In the fourth position 71D, the drive pulley 24 continues to rotate, but as noted above the belt 32 does not travel across the pulleys. Although the drive pulley 24 is described as continuing to rotate, the present invention is not limited in this regard as the knife sharpening apparatus is adaptable to other modes of operation, including but not limited to stopping rotation of the drive pulley before, after or coincident with the pulley and belt assembly 10 being releasably secured in the disengaged position and gradually reducing and/or increasing drive pulley speed.

Referring back to FIG. 9, the knife sharpening apparatus 9 includes a substantially rod shaped linkage 88 fitted though an opening 89 in the second frame surface 39 of the frame 12. One end of the linkage 88 is accessible to an operator and an opposing end of the linkage is secured to the support member 26. Activation and/or deactivation of the linkage 88 by movement of the linkage down and/or up as shown by the arrow L causes a corresponding movement of the support member 26 about the support member rotational axis S. When the pulley and belt assembly 10 is releasably secured in the disengaged position by the detent member 72 (e.g., the fourth position 71D), partial removal of the knife blade 46 from the guide slot 34, 34' and urging the linkage 88 upwardly causes the detent member to release the journal 70 and returns the pulley and belt assembly to one of the engaged positions (e.g., 71A-71C). When the pulley and belt assembly 10 is within one of the engaged positions (e.g., 71A-71C), urging the linkage 88 downwardly causes the detent member 72 to engage the journal 70 and returns the pulley and belt assembly to the disengaged position. While the linkage 88 is described as being substantially rod shaped the present invention is not limited in this regard as the knife sharpening apparatus is adaptable to employ other shape linkages and linkages including multiple members such as but not limited to a rotatable shaft having a lever arm engaging the support member 26 and a pair of linkages including one to engage the detent member 72 with the journal 70 and another linkage to disengage the detent member from the journal.

Figure 20:
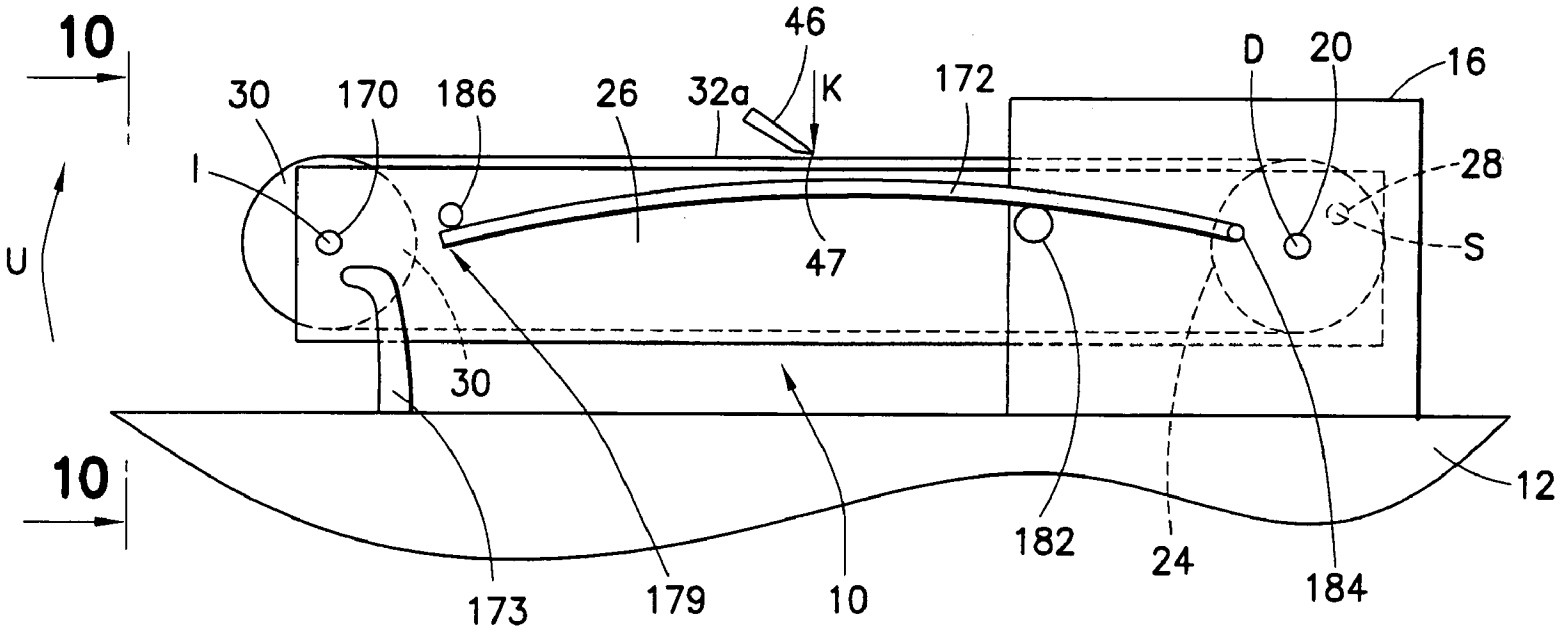
FIG. 20 is a side view of a pulley and belt assembly including a cantilever type biasing member and a detent member.
Figure 21:
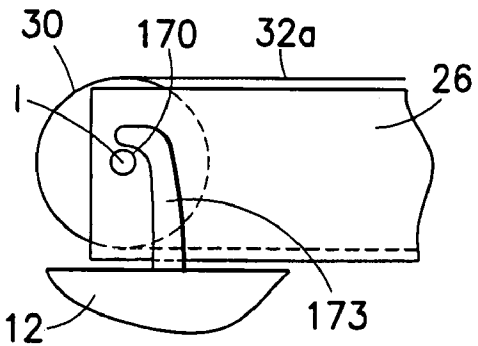
FIG. 21 is a partial side view of the detent member of FIG. 20.

Referring to FIGS. 20-21, in one embodiment, the pulley and belt assembly 10 include a cantilever type biasing member 172 having one end thereof secured to the mounting plate 16 with a fastener 184. An opposing end of the biasing member 172 slidingly engages a first journal 186 secured to the support member 26. An unsecured end 179 of the biasing member 172 is flexed over a second journal 182 and is in sliding engagement therewith. The biasing member 172 urges the unsecured end 179 of the biasing member 172 upwardly in the direction indicated by the arrow U against an under side of the first journal 186 to bias the support member 26 into the engaged position. Referring to FIG. 21, the knife sharpening apparatus 9 includes a detent member 173 projecting from the frame 12 for releasable engagement with a third journal 170 projecting from the support member 26 coaxially with the idler pulley rotational axis I. FIG. 21 illustrates the detent member 173 releasably engaging the third journal 170 and thereby releasably securing the support member 26 in the disengaged position. Although, a cantilever type biasing member 172 and separate detent member 173 have been described the present invention is not limited in this regard as the knife sharpening apparatus is adaptable to operating with other biasing member and/or detent member designs including but not limited to coil springs, ball and groove detent members, solenoid operated detent members, and combinations thereof. While the biasing member 172 is described as slidingly engaging the first journal 186 and second journal 182, the present invention is not limited in this regard as the biasing member is adaptable to slidingly engage portions of the support member 26 and/or at least one of the first journal 186 and second journal 182.

Figure 22:
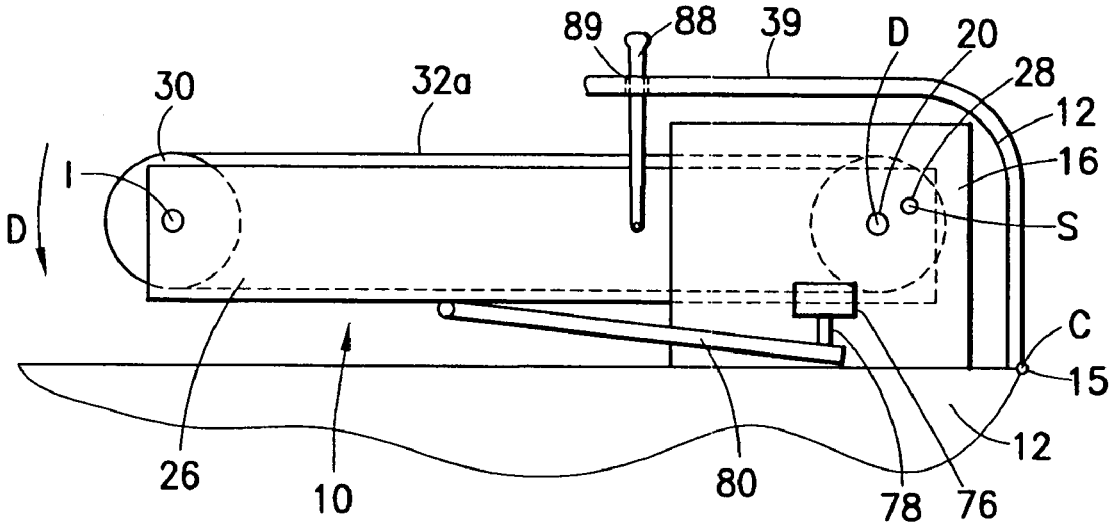
FIG. 22 is a side view of the pulley and belt assembly of FIG. 20 in a disengaged position and including a switch.

Referring to FIG. 22, the knife sharpening apparatus 9 is shown with the pulley and belt assembly 10 in the disengaged position and rotated downwardly in the direction indicated by arrow D, about the support member rotational axis S. The knife sharpening apparatus 9 includes a switch 76 coupled to the mounting plate 16. The switch 76 includes a plunger 78 projecting therefrom for opening and closing an electrical circuit within the apparatus. The support member 26 includes an extension rod 80 secured thereto for activation of the plunger 78. In the disengaged position, the extension rod 80 is spaced apart from the plunger 78 which is extended outwardly from the switch 76 such that the electrical circuit is open.

Figure 23:
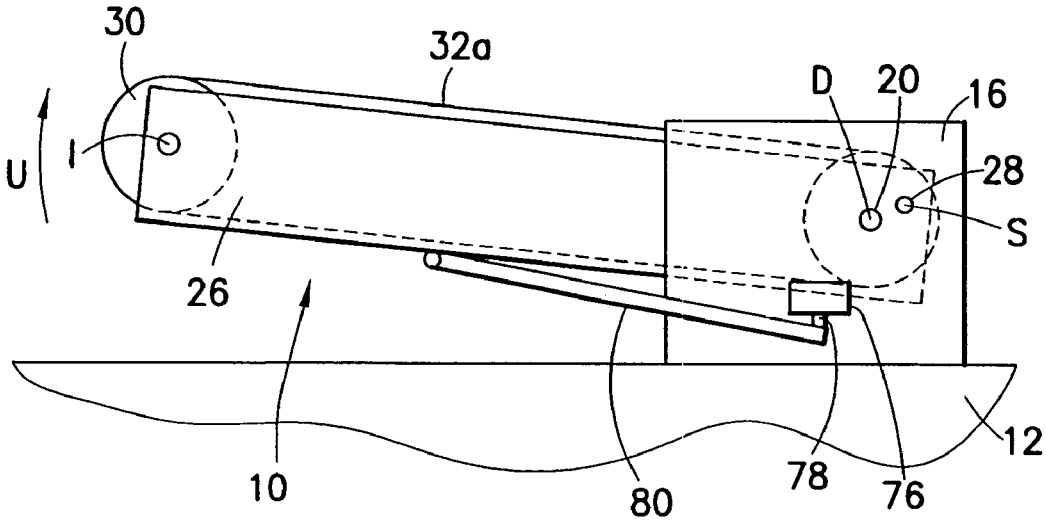
FIG. 23 is a side view of the pulley and belt assembly of FIG. 20 in an engaged position and including the switch.

Referring to FIG. 23, the knife sharpening apparatus 9 is shown with the pulley and belt assembly 10 in the engaged position and rotated upwardly in the direction indicated by arrow U, about the support member rotational axis S. In the engaged position, the extension rod 80 is urges the plunger 78 into the switch 76 such that the electrical circuit is closed, to energize the motor 18.

In one embodiment, the electrical circuit includes the motor 18 in electrical communication with the switch 76. The motor 18 drives the drive pulley 28. As illustrated in FIGS. 22 and 23, operation of the switch 76 stops the motor when the pulley and belt assembly 10 is in the disengaged position and starts the motor when the pulley and belt assembly 10 is in the engaged position. In one embodiment, activation and/or deactivation of the linkage 88 causes rotation of the support member 26 about the support member rotational axis, thereby causing the extension rod 80 to operate the plunger 78 of the switch 76 and opens and/or closes the electrical circuit as described above.

Figure 24:
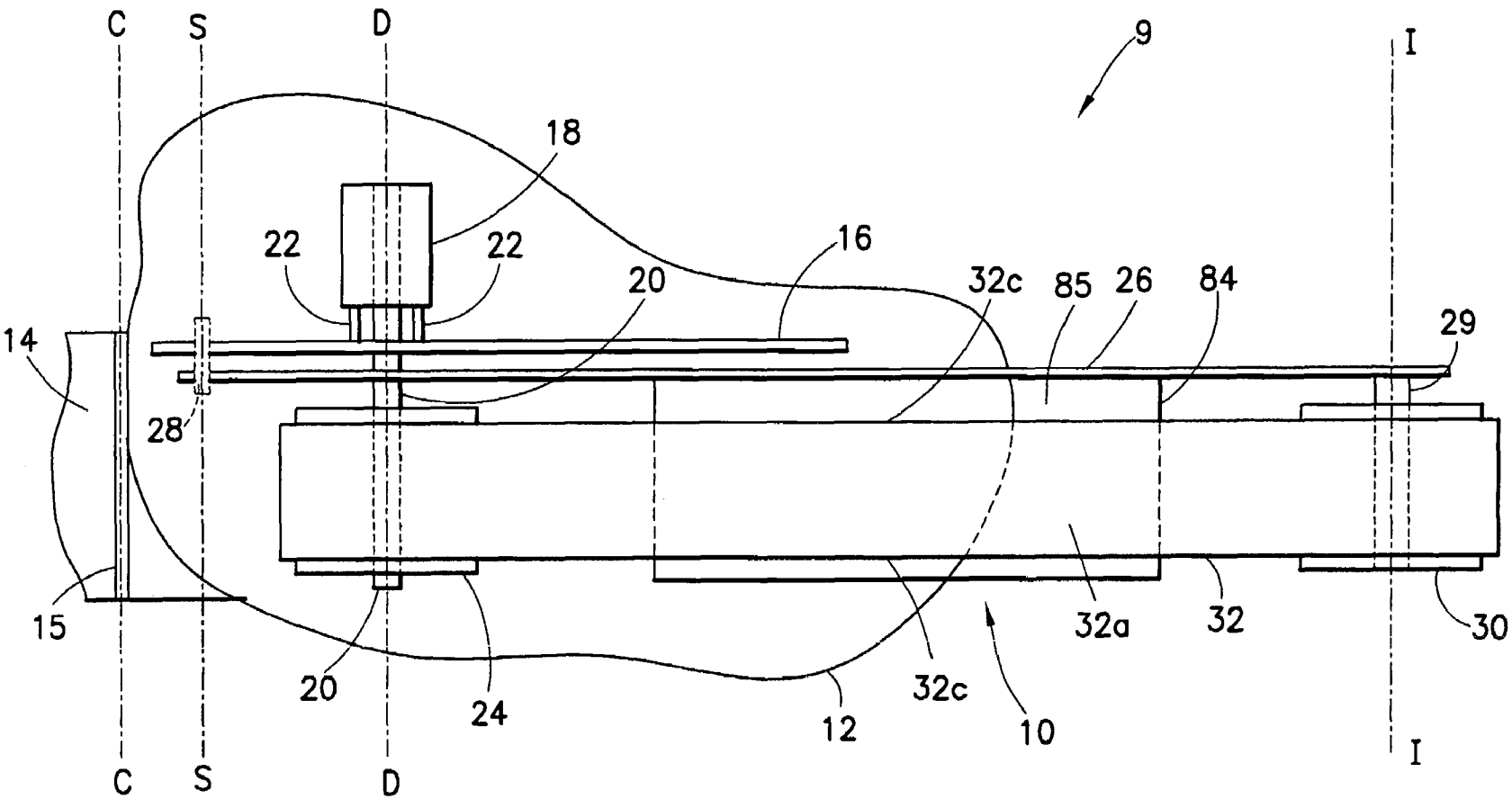
FIG. 24 is a top view of the sharpening apparatus of FIG. 1 having a belt support plate.
Figure 25:
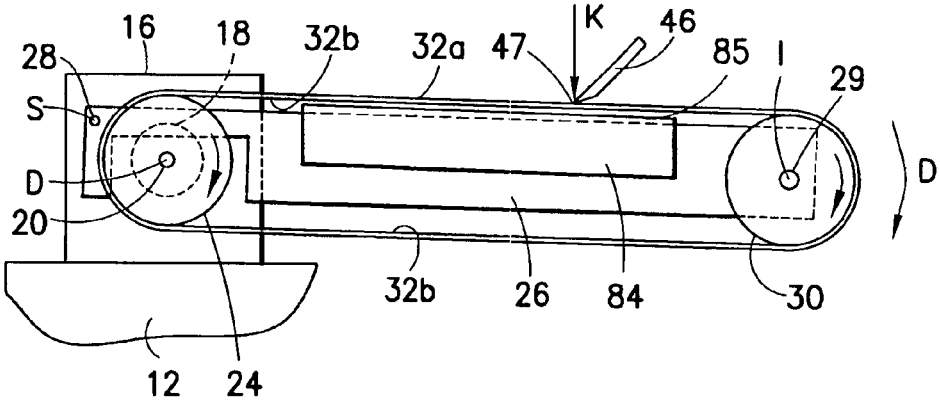
FIG. 25 is a partial side view of the sharpening apparatus of FIG. 20.

Referring to FIGS. 24-25, the knife sharpening apparatus 9, includes a belt support plate 84 secured to the support member 26 in an area where the cutting edge engages the belt 32. The belt support plate 84 includes an upwardly facing substantially planar bearing surface 85 positioned adjacent and substantially parallel to the drive surface 32*b* of the belt 32. During operation, the force K is applied to the belt 32 by the cutting edge 47 of the knife blade 46 causing the drive surface 32*b* to engage the belt support plate 84 and transmit the force K through the belt 32 to the bearing surface 85. Thus application of the force K to the bearing surface 85 causes the support member 26 to rotate downwardly in the direction indicated by the arrow D about the support member rotational axis S. Increasing and/or decreasing the force K causes reduction and/or increase in belt tension, respectively, similar to that described above without substantial deflection of the belt occurring before belt tension is adjusted. The belt support plate 84 thus decreases a reaction time between when the force is applied to and/or relieved from the belt and when the belt tension decreases and/or increases, respectively. Reduction of the reaction time further helps prevent the cutting edge from over heating and to prevent damage to the cutting edge 47 and the belt 32.

Figure 26:
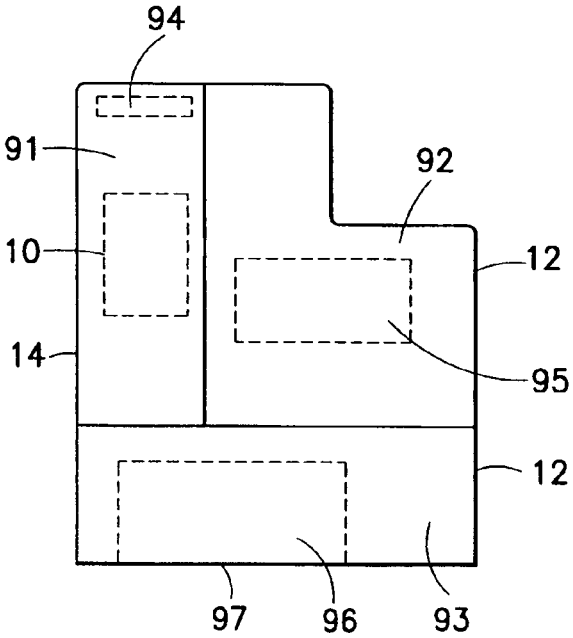
FIG. 26 is a front view of a cover and frame assembly for a sharpening apparatus, in accordance with one embodiment of the present invention.

Referring to FIG. 26, in one embodiment, the knife sharpening apparatus 9 includes a frame and cover assembly having an abrading cavity 91, a motor cavity 92 and a battery cavity 93 partitioned apart from one another. The abrading cavity 91 houses the pulley and belt assembly 10, a device for collecting abrading dust 94 and various supporting elements. In one embodiment, the device for collecting abrading dust includes open cell foam. The motor cavity 92 houses at least a motor 95, switches and wiring. The battery cavity 93 houses at least a battery 96, wiring and connections for charging the battery. In one embodiment, the battery 96 is removable and replaceable via suitable access to the battery cavity 93.

Figure 27:
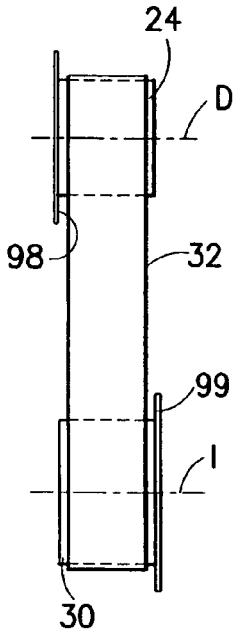
FIG. 27 is a top view of a drive pulley, idler pulley and belt including a belt tracking device.

Referring to FIG. 27, in one embodiment, the knife sharpening apparatus 9 includes a belt tracking device for maintaining alignment of the belt on the drive pulley and the idler pulley. In one embodiment, the belt tracking devices includes a first flange 98 secured to an edge of the drive pulley and a second flange 99 secured to the edge of the idler pulley 30. As shown in FIG. 27, the first flange 98 and the second flange 99 are disposed on opposing sides of the belt 32 and cooperate to keep the belt aligned as the belt travels along the path between the drive pulley 24 and the idler pulley 30. While the first and second flanges are shown on opposing sides of the belt, the present invention is not limited in this regard as the positions of the flanges can be reversed or can be positioned on a common side of the belt 32.

Figure 28:
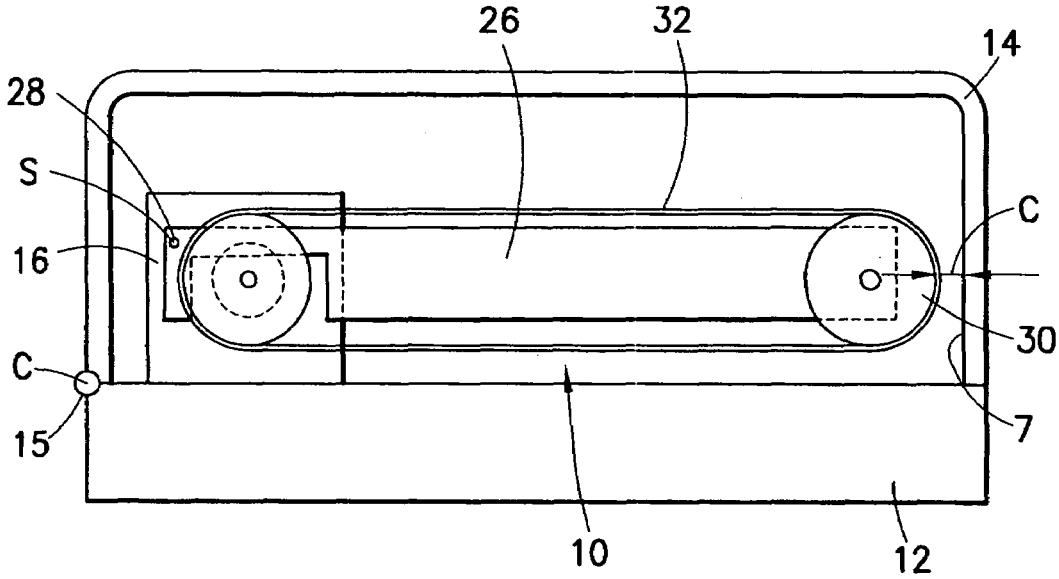
FIG. 28 is a partial cross sectional side view of the sharpening apparatus of FIG. 1.

Referring to FIG. 28, in one embodiment, the cover 14 includes a substantially concave inside surface 7 defining a cavity therein. When the cover 14 is closed against the frame 12 and the pulley and belt assembly 10 is in the disengaged position the idler pulley 30 clears the inside surface 7 as illustrated by dimension C.

Figure 29:
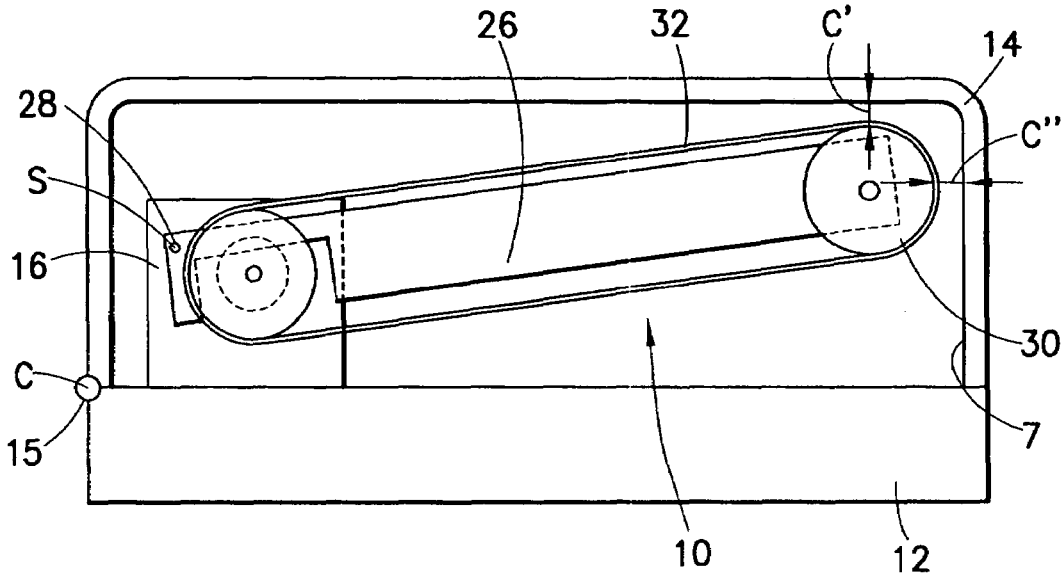
FIG. 29 is a partial cross sectional side view of a sharpening apparatus of FIG. 1.

Referring to FIG. 29, in one embodiment, when the cover 14 is closed against the frame 12 and the pulley and belt assembly 10 is in the engaged position the idler pulley 30 clears the inside surface 7 as illustrated by dimension C' and C".

Figure 30:
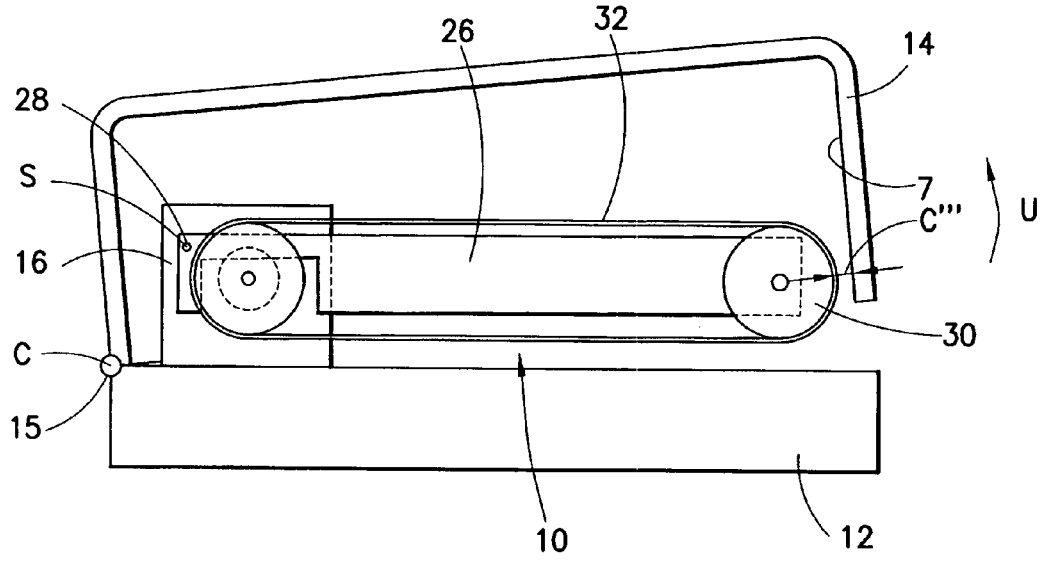
FIG. 30 is a partial cross sectional side view of a sharpening apparatus of FIG. 1.

Referring to FIG. 30, in one embodiment, when the pulley and belt assembly 10 is in the disengaged position the idler pulley 30 clears the inside surface 7 of as illustrated by dimension C'" and the cover 14 is capable of fully opening.

Figure 31:
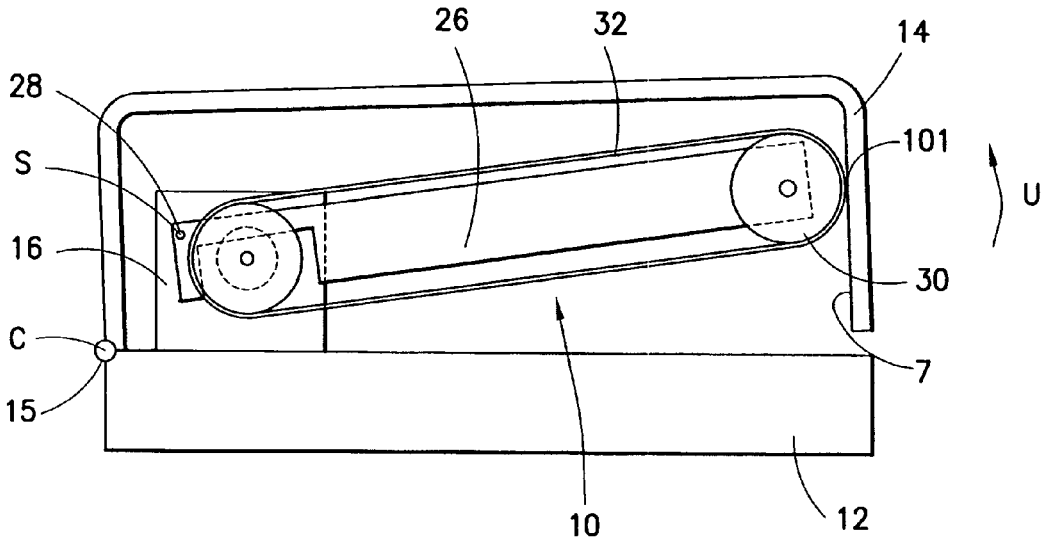
FIG. 31 is a partial cross sectional side view of a sharpening apparatus of FIG. 1.

Referring to FIG. 31, in one embodiment, the knife sharpening apparatus includes a cover 14 to frame 12 interlock device. The interlock device prevents substantial opening of the cover 14 when the pulley and belt assembly 10 is in the engaged position. For example, when an operator attempts to partially open the cover 14 when the pulley and belt assembly 10 is in the engaged position, the idler pulley 30 interferes at an abutment surface 101 of the inside surface 7 to prevent the cover 14 from opening further. In one embodiment, the abutment surface 101 is offset from the inside surface. Thus the cover interlock device is included for safety reasons, for example, to prevent injury to the operator due to contact with moving parts housed within the cover 14. In one embodiment, the interlocking device includes a second switch in electrical communication with the motor 18. The second switch is activated by opening and closing the cover. When the cover is moved towards the open position the second switch severs the electrical communication thus stopping the motor 18. With the cover closed the second switch restores the electrical communication thus enabling the motor to operate.

A method for sharpening a cutting edge of a cutting tool is provided. The method includes providing an endless belt rotating in a path about a plurality of pulleys. At least one of the pulleys is affixed to a support member pivoting about a rotational axis between an engaged position and a disengaged position. The method also includes engaging the belt with the cutting edge to impart a force on the belt and sharpen the cutting edge; wherein when the force is at and below a first threshold, the support member is in the engaged position and the endless belt rotates at a first rotational speed; increasing the force above the first threshold toward a second threshold; and in response to the increased force, rotating the support member from the engaged position toward the disengaged position and decreasing a tension in the belt such that the belt rotates at a second rotational speed that is less than the first rotational speed.

In one embodiment, wherein when the force is at and above the second threshold, the method includes rotating the support member into the disengaged position and releasing substantially all tension in the endless belt such that the belt stops travel along the path.

In one embodiment, wherein when the force is decreasing from and below the second threshold, the method includes rotating the support member toward the engaged position and increasing tension in the belt and increasing rotation of the belt along the path toward the first rotational speed.

In another embodiment, the method includes selectively engaging the belt with the cutting edge to impart intermittently increasing and decreasing force on the belt; and in response to the intermittently increasing force, rotating the support member from the engaged position toward the disengaged position and decreasing a tension in the belt such that the belt rotates from the first to the second rotational speed; and in response to the intermittently decreasing force, rotating the support member from the disengaged position toward the engaged position and increasing a tension in the belt such that the belt rotates from the second to the first rotational speed.

Although the present invention has been disclosed and described with reference to certain embodiments thereof, it should be noted that other variations and modifications may be made, and it is intended that the following claims cover the variations and modifications within the true spirit of the invention.

What is claimed is:

1. An apparatus for sharpening a cutting tool having a cutting edge, said apparatus comprising:

a frame having at least one guide slot;

a motor having a drive shaft, said motor coupled to said frame, said drive shaft defining a drive pulley rotational axis;

a drive pulley coupled to said drive shaft and rotating about said drive pulley rotational axis when said motor is activated;

at least one idler pulley rotating about an idler pulley rotational axis;

a support member pivotably coupled to said frame and pivoting about a support member rotational axis between an engaged position and a disengaged position, wherein said idler pulley rotational axis is fixed relative to said support member;

an endless belt having an abrading surface, said endless belt trained in a path over said drive pulley and said at least one idler pulley, said endless belt rotating along said path in response to rotation of said drive pulley; and a biasing member coupled to said frame and biasing said support member toward said engaged position;

wherein when said cutting edge traverses said at least one guide slot in a direction toward said endless belt, said cutting edge engages said abrading surface imparting a force on said belt to sharpen said cutting edge;

wherein when said force is at and below a first threshold, said support member is in said engaged position and said belt rotates along said path at a first rotational speed; and wherein when said force increases from said first threshold toward a second threshold, said support member and biasing member respond to said force to pivot said support member from said engaged position toward said disengaged position and decrease tension in said belt such that said belt rotates along said path at a second rotational speed that is reduced from said first rotational speed.

2. The apparatus of claim 1, wherein when said force increases to said second threshold, said support member and biasing member respond to said increased force to pivot said support member into said disengaged position and release substantially all tension in said belt causing said belt to stop travel along said path.

3. The apparatus of claim 1, comprising:

a detent member for releasably securing said support member in said disengaged position wherein the belt tension is released.

4. The apparatus of claim 1, wherein when said cutting edge traverses said guide slot in a direction away from said endless belt, said force decreases and said support member and biasing member respond to said decreasing force to pivot said support member toward said engaged position and increase tension in said belt such that said belt rotates along said path toward said first rotational speed.

5. The apparatus of claim 1, wherein said drive pulley rotational axis is positioned between said idler pulley rotational axis and said support member rotational axis.

6. The apparatus of claim 1, further comprising:

a linkage having a first end and a second end;

said first end being secured to said support member; and said second end being accessible by an operator for causing rotation of said support member about said support member rotational axis.

7. The apparatus of claim 1, comprising:

a plate extending from said support member;

said plate having a bearing surface disposed substantially parallel to and adjacent a driving surface of said belt, said driving surface opposite said abrading surface; and wherein said force is impaired on said belt, said bearing surface supports said driving surface.

8. The apparatus of claim 1, comprising:

at lest one switch for opening and closing an electrical circuit, said at least one switch having an operable portion;

said motor and said at least one switch being in electrical communication with said electrical circuit; and wherein rotation of said support member to said disengaged position causes a portion of said support member to engage said operable portion of said at least one switch to open said electrical circuit disconnecting power to said motor.

9. The apparatus of claim 1, comprising:

at least one switch for opening and closing an electrical circuit, said at least one switch having an operable portion;

said motor and said at least one switch being in electrical communication with said electrical circuit; and wherein rotation of said support member to said engaged position causes a portion of said support member to disengage said operable portion of said at least one switch to close said electrical circuit connecting power to said motor.

10. The apparatus of claim 9, comprising:

a battery in electrical communication with said electrical circuit for providing electrical power to said circuit.

11. The apparatus of claim 1, comprising:

a cover hingedly cooperating with said frame to house at least said belt, said support member, said drive pulley, and said idler pulley;

said cover having a substantially concave inside surface defining an abutment surface thereon; and wherein when in said engaged position and said cover is rotated towards an open direction, said abutment surface interferes with a portion of said idler pulley thereby precluding further opening of said cover.

12. The apparatus of claim 1, comprising:

a cover hingedly cooperating with said frame to house at least said belt, said support member, said drive pulley, and said idler pulley;

said cover having a substantially concave inside surface defining an abutment surface thereon; and wherein when in said disengaged position and said cover is rotated towards an open direction, said abutment surface clears said idler pulley enabling further opening of said cover.

13. The apparatus of claim 1, comprising:

said at least one guide slot including at least one guide surface for limiting angular rotation of said cutting edge relative to the belt.

14. The apparatus of claim 1, comprising:

belt tracking means disposed on at least one of said drive pulley and said idler pulley for maintaining alignment of said belt on said drive pulley and said idler pulley.

15. The apparatus of claim 14, wherein said belt tracking means comprises at least one flange disposed on an outer edge of at least one of said idler pulley and said drive pulley.

16. The apparatus of claim 14, wherein said belt tracking means comprises:

a first flange disposed on an outer edge of at least one of said idler pulley and said drive pulley; and a second flange disposed on an inner edge of at least one of said idler pulley and said drive pulley;

wherein said first and second flanges are disposed on opposing ones of said idler and drive pulleys.

17. A method for sharpening a cutting edge of a cutting tool, the method comprising steps of:

providing an endless belt rotating in a path about a plurality of pulleys, at least one of the pulleys affixed to a support member pivoting about a rotational axis between an engaged position and a disengaged position;

engaging the belt with the cutting edge to impart a force on the belt and sharpen the cutting edge;

wherein when the force is at and below a first threshold, the support member is in the engaged position and the endless belt rotates at a first rotational speed;

increasing the force above the first threshold toward a second threshold; and in response to the increased force, rotating the support member from the engaged position toward the disengaged position and decreasing a tension in the belt such that the belt rotates at a second rotational speed that is less than the first rotational speed.

18. The method of claim 17, further including:

wherein when the force is at and above the second threshold, rotating the support member into the disengaged position, releasing substantially all tension in the endless belt such that the belt stops travel along the path.

19. The method of claim 17, further including:

wherein when the force is decreasing from and below the second threshold, rotating the support member toward the engaged position, increasing tension in the belt and increasing rotation of the belt along the path toward the first rotational speed.

20. The method of claim 17, further comprising:

selectively engaging the belt with the cutting edge to impart intermittently increasing and decreasing force on the belt;

in response to the intermittently increasing force, rotating the support member from the engaged position toward the disengaged position and decreasing a tension in the belt such that the belt rotates from the first to the second rotational speed; and in response to the intermittently decreasing force, rotating the support member from the disengaged position toward the engaged position and increasing a tension in the belt such that the belt rotates from the second to the first rotational speed.

* * * * *